US006726385B1

(12) United States Patent
Borowski

(10) Patent No.: US 6,726,385 B1
(45) Date of Patent: Apr. 27, 2004

(54) LOTION APPLICATION DEVICE

(76) Inventor: Angela Holman Borowski, 9301 S. Harlem, Apt. 9-B, Oaklawn, IL (US) 60453

( * ) Notice: Subject to any disclaimer, the term of this patent is extended or adjusted under 35 U.S.C. 154(b) by 0 days.

(21) Appl. No.: 10/245,255

(22) Filed: Sep. 17, 2002

Related U.S. Application Data

(63) Continuation-in-part of application No. 10/002,236, filed on Nov. 2, 2001, now abandoned, which is a continuation-in-part of application No. 09/692,432, filed on Oct. 19, 2000, now abandoned.

(51) Int. Cl.[7] ..... A46B 5/02; A46B 11/02

(52) U.S. Cl. ..... 401/6; 401/187; 401/188 R; 401/205

(58) Field of Search ..... 401/6, 187, 188 R, 401/189, 205, 206, 183, 184, 185, 186

(56) References Cited

U.S. PATENT DOCUMENTS 6,129,469 A * 10/2000 Messer et al. ..... 401/6
6,412,997 B2 * 7/2002 Berke et al. ..... 401/6

* cited by examiner

*Primary Examiner*—David J. Walczak
(74) *Attorney, Agent, or Firm*—John D. Gugliotta; P. Jeff Martin

(57) ABSTRACT

A handled device that aids one in applying tanning oil, lotion or sun screen to their back region and other hard-to-reach areas. The long handle portion allows the user to reach the desired area with enhanced ease. The long handle portion includes an elongated handle that supports a head with a flat applicator pad constructed of a sponge-like material. The head includes a reservoir that the user fills with the preferred tanning lotion or oil. Connected to a squeeze pump located on the handle opposite the head, the user pressurizes the reservoir, causing the lotion/oil to be forced through exit apertures to the applicator pad.

9 Claims, 5 Drawing Sheets

LOTION APPLICATION DEVICE

RELATED APPLICATIONS

The present invention is a Continuation in Part of Ser. No. 10/002,236, filed on Nov. 2, 2001, now abandoned, which is a Continuation in Part of Ser. No. 09/692,432, filed on Oct. 19, 2000, now abandoned.

BACKGROUND OF THE INVENTION

1. Field of the Invention

The present invention relates generally to application devices for applying tanning oils, lotions and sun screens, and, more particularly, to a removable sponge type lotion application device having an articulating, telescoping handle and neck that allows a user to cover completely his or her back region in an easy and convenient manner.

2. Description of the Related Art

Many people enjoy spending their days sun bathing, swimming and performing other outdoor recreational activities under open skies and in the hot summer sun. While these people are often rewarded with a golden tan, they also risk the dangers related to sun burns, sun poisoning and even skin cancer. As a result, most people resort to the use of tanning oils, lotions and sun screens in order to block the harmful UV rays that produce the aforementioned ailments. While these products are effective in providing UV protection, they require that an adequate layer be applied over all of the exposed skin surfaces. While one can usually apply the lotion or oil over the majority of the body, coverage of one's back region is difficult and usually impossible without the aid of another person. As a result, those that perform these activities alone are forced either to go through extreme difficulty in the application of skin protection or, worse yet, must go unprotected. Accordingly, the need has developed for a means by which one can apply tanning oils, lotions and sun screens to his/her back region and other hard-to-reach areas easily and in a manner so as to provide complete and adequate coverage. The development of the present invention fulfills this need.

A search of the prior art did not disclose any patents that read directly on the claims of the instant invention. However, several references to handled lotion application devices were discovered. These devices neither anticipate nor disclose any embodiment that would preclude the novelty and the utilitarian functionality of the features of the present invention.

The following patents disclose a lotion applicator in which a supply of lotion is stored in a sponge.

U.S. Pat. No. 5,845,659 issued in the name of Hutchins

U.S. Pat. No. 5,353,819 issued in the name of Kahn et al.

U.S. Pat. No. 4,896,984 issued in the name of Evans

The following patents describe the design and function of a liquid applicator with an elongated delivery member.

U.S. Pat. No. 4,078,865 issued in the name of Moser

U.S. Pat. No. 3,455,638 issued in the name of Braswell

U.S. Pat. No. D 294,202 issued in the name of Adair

The following patents disclose the ornamental design of a lotion applicator.

U.S. Pat. No. D 396,328 issued in the name of Jarvis

U.S. Pat. No. D 374,947 issued in the name of Chiaramonte

U.S. Pat. No. D 308,264 issued in the name of Redmann et al.

U.S. Pat. No. D 343,297 issued in the name of Haines describes the ornamental design of a combined brush and sponge for applying suntan lotion.

While several features exhibited within these references may be incorporated into this invention, alone and in combination with other elements, the present invention is sufficiently different so as to make it distinguishable over the prior art.

SUMMARY OF THE INVENTION

The present invention is a handled device that is intended to aid the user in applying tanning oil, lotion or sun screen to the back region and other hard-to-reach areas. The head is pivotable and as such allows the user to reach the desired area with enhanced ease. The present invention includes a plastic handle assembly that supports a head with a flat applicator pad constructed of a sponge-like material. The head includes a reservoir that the user fills with the preferred tanning lotion or oil. Once the reservoir is filled, it is applied to the applicator pad by use of an internal release pump mechanism which is routed internal to the invention. Thus it can be utilized to apply a coat of lotion or oil to his/her entire back area, unassisted.

Furthermore, additional uses such as soap applications in a shower setting are also available. Regardless of the application, use of the present invention ensures both efficient and effective access to those hard-to-reach areas.

It is therefore an object of the present invention to provide a lotion application device wherein sun screen, tanning lotions and tanning oils can be applied to one's back and other hard-to-reach areas easily and effectively, providing complete coverage thereof.

It is another object of the present invention to provide a lotion application device that eliminates the need for the assistance of a second person to apply lotion or oil to one's back.

It is another object of the present invention to provide a lotion application device that applies an even coat of sun screen, tanning lotions and tanning oils.

It is another object of the present invention to provide a lotion application device that includes a refillable reservoir that allows the user to select a preferred lotion or oil for use therewith.

It is another object of the present invention to provide a lotion application device that includes a pneumatic delivery system in which a squeeze handle is used to deliver the lotion or oil to an applicator head.

It is another object of the present invention to provide a lotion application device that includes a rotatably adjustable handle that allows for enhanced reach.

Finally, it is an object of the present invention to provide a lotion application device that includes a pivoting head for maintaining even contact with one's skin surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
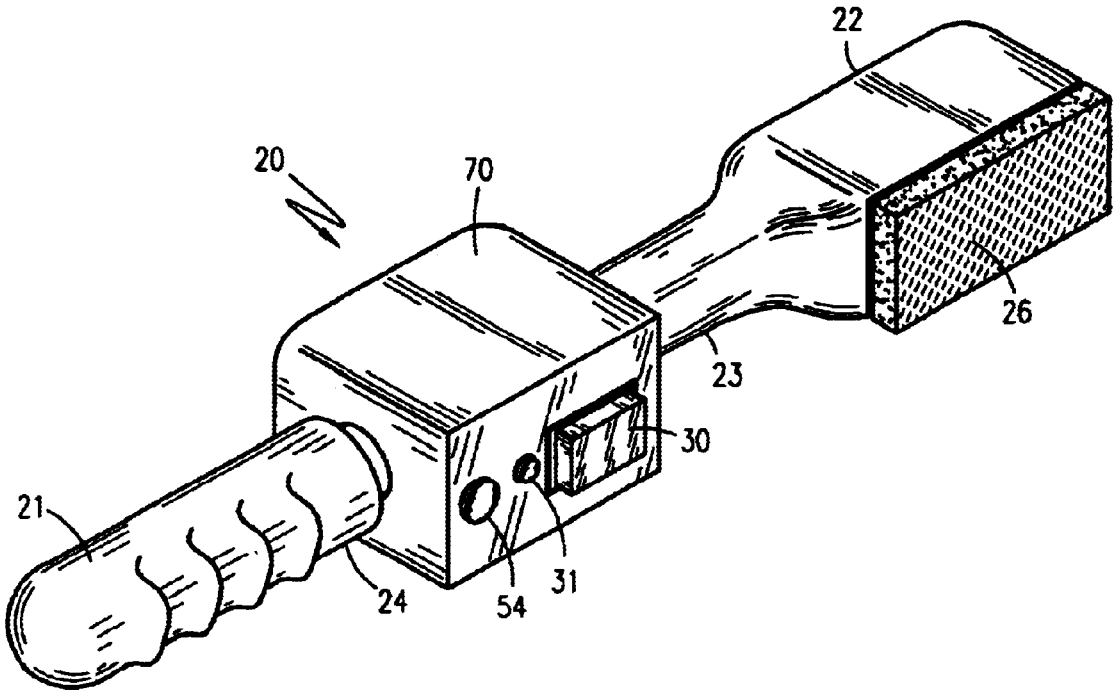
FIG. 1 is a perspective view of the lotion application device, according to the preferred embodiment of the present invention.
Figure 2:
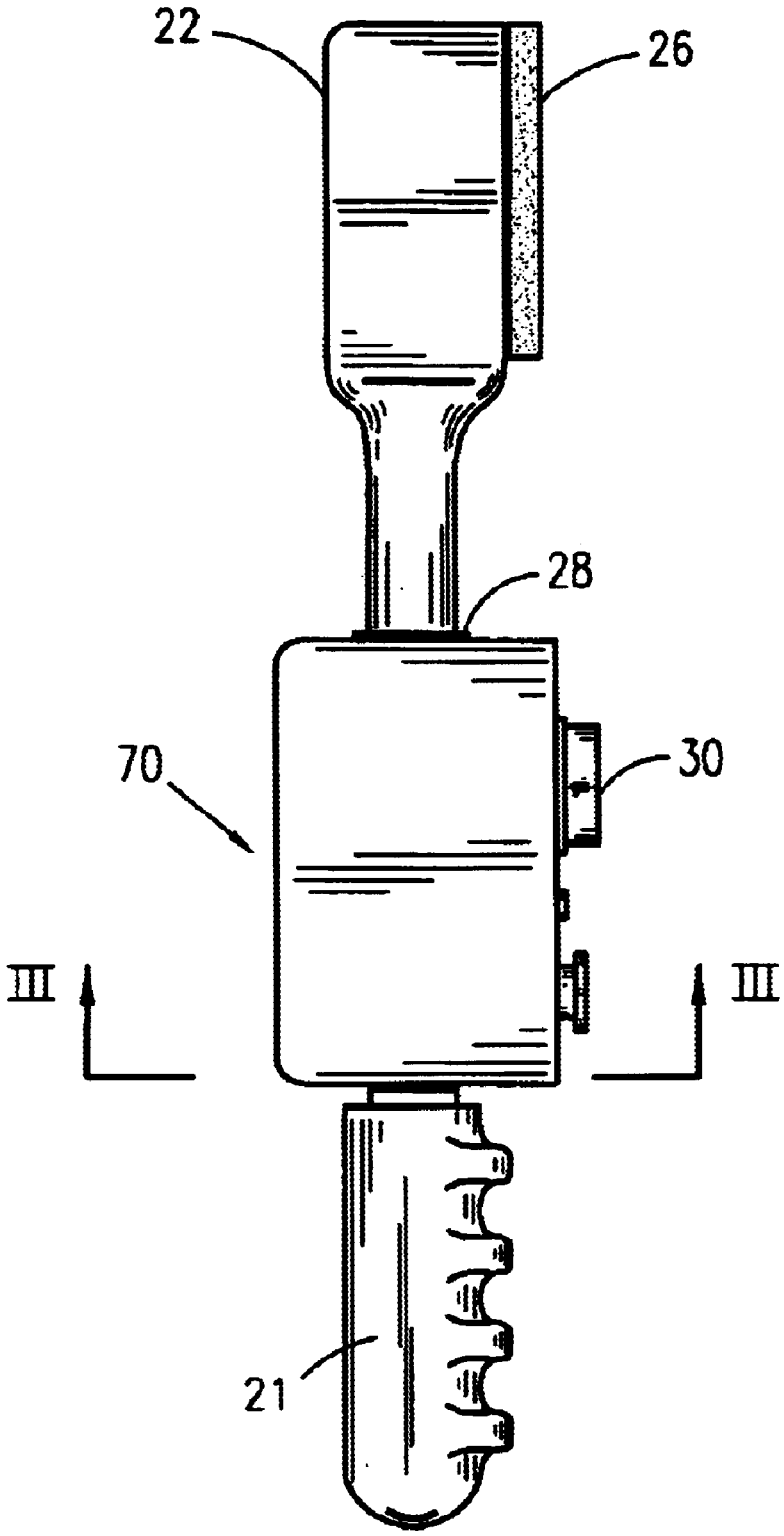
FIG. 2 is a side view of the lotion application device, according to the preferred embodiment of the present invention.
Figure 3:
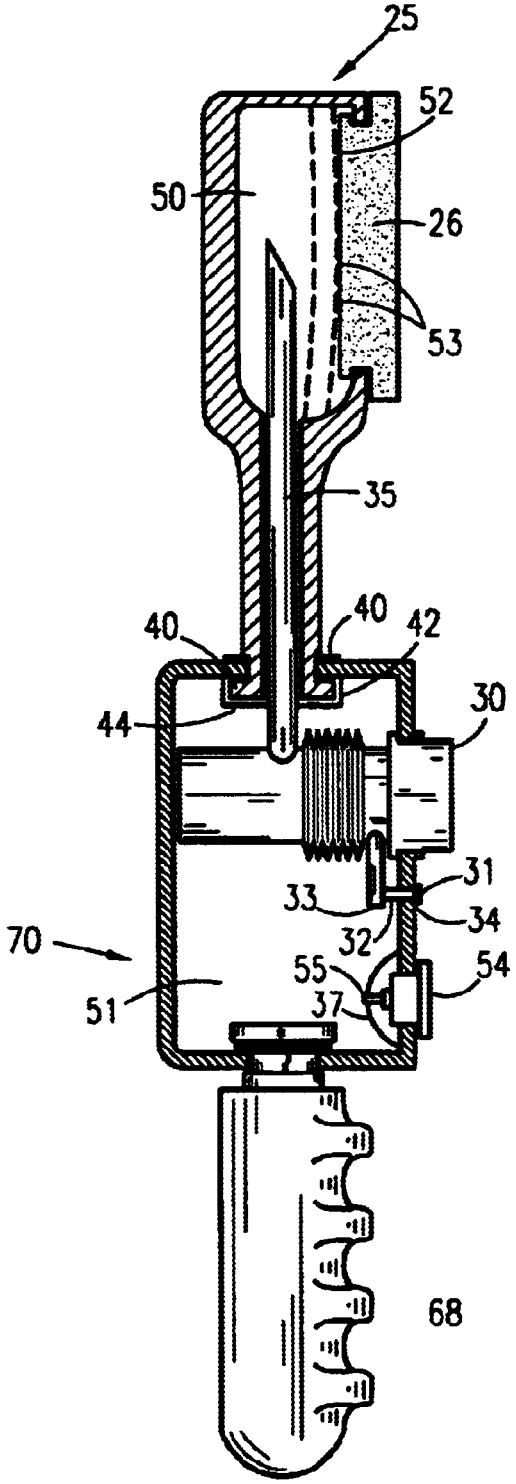
FIG. 3 is a partial cross-sectional view revealing the internal components of the present invention according to the preferred embodiment.
Figure 4A:
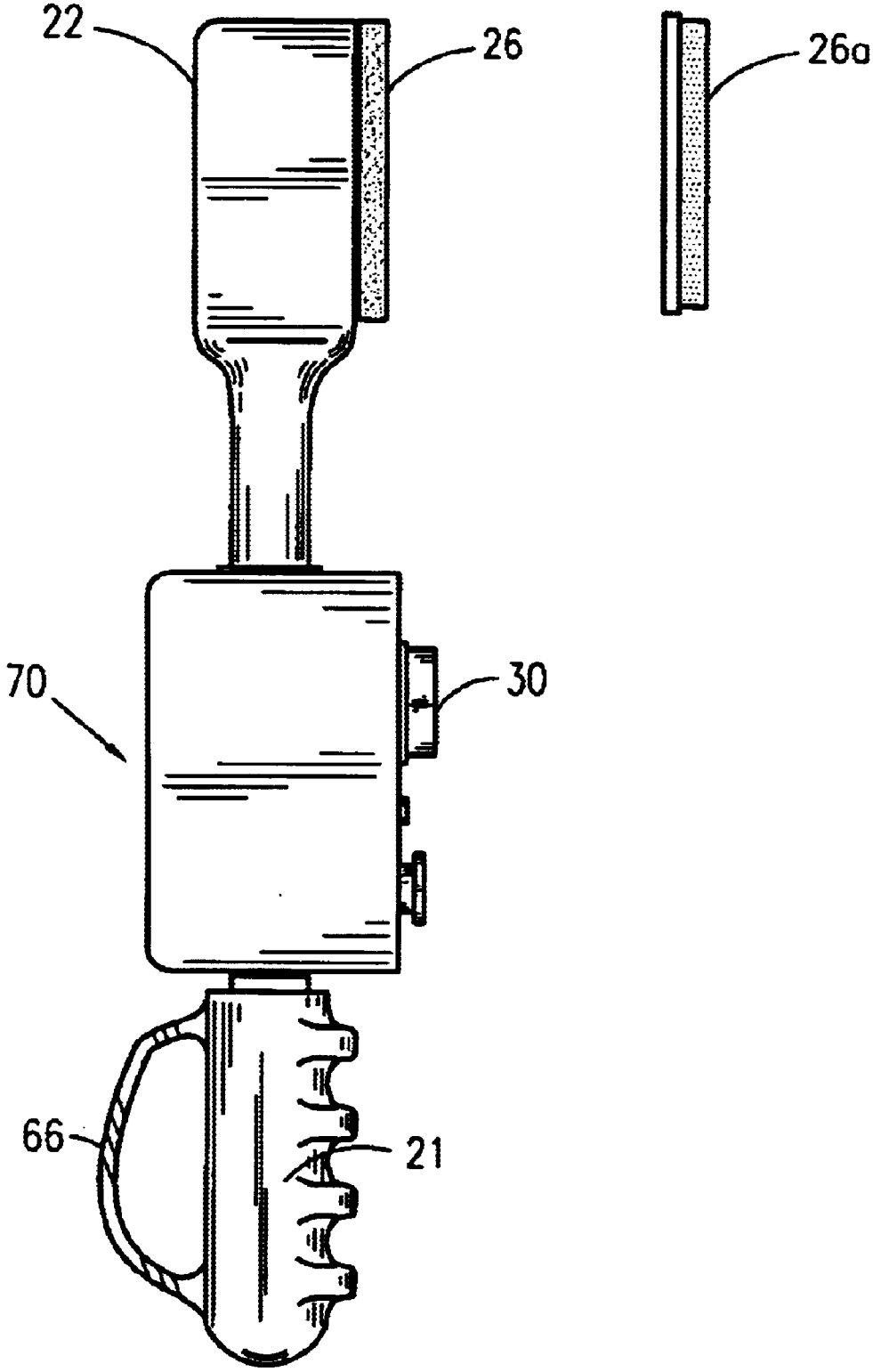
FIG. 4*a* is a side view of the lotion application device illustrating the handle strap and application pad cover, according to the preferred embodiment of the present invention.
Figure 4B:
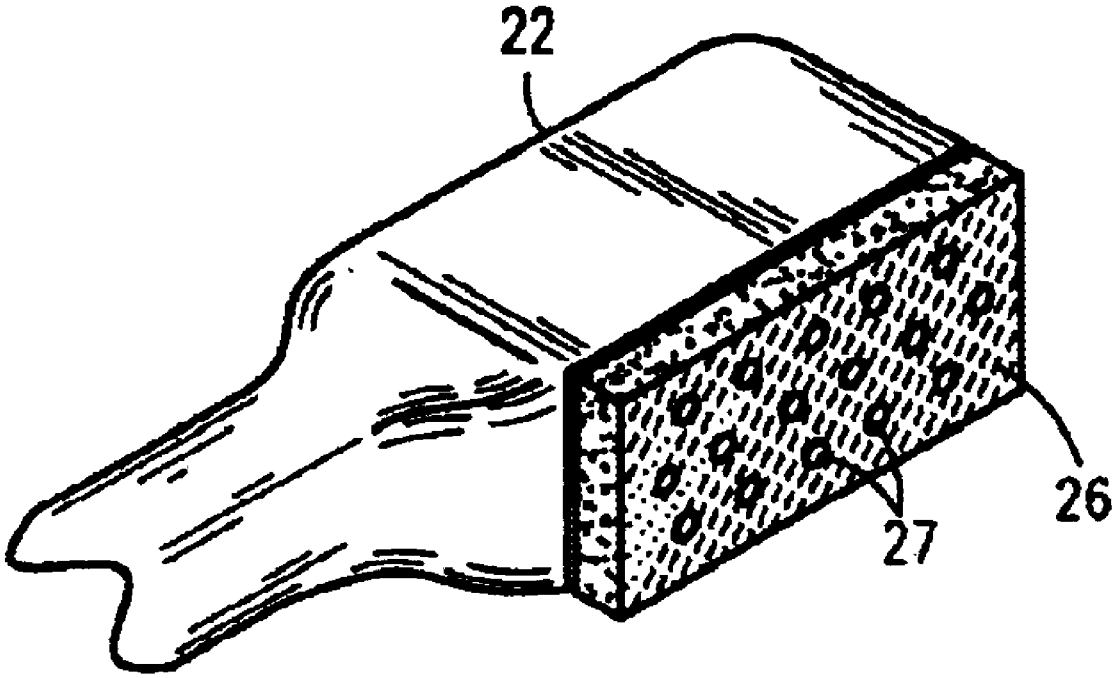
FIG. 4*b* is a side view of the lotion application device illustrating nubs of the application pad, according to the preferred embodiment of the present invention.

Referring now to FIGS. 1–4*b*, depicted is the lotion application device, hereinafter lotion applicator 20, according to the preferred embodiment of the present invention. The lotion applicator 20 comprises, generally, a two-piece handle 21 that supports an applicator head 22. The handle 21 has an upper handle length 23 rotatably connected to a lower handle length 24, the connection being located near the midpoint of the handle 21 length and includes a handle rotation joint 40 that allows for the rotation of the upper handle length 23 with respect to the lower handle length 24. The lower handle length 24 features a molded design wherein finger grooves 68 enhance one's grip while using the lotion applicator 20. The applicator head 22 includes a rigid head housing 25 encasing a dispensing reservoir 50 that supports an applicator pad 26. An applicator pad cover 26*a* protects the applicator pad 26 when not in use, preventing the accumulation of dirt and debris and preventing the pad material from drying out.

The dispensing reservoir 50 has a dispensing surface 52 that engages with the applicator pad 26. The dispensing surface 52 has a plurality of dispensing apertures 53 spaced thereabout that allow for the dispensing of lotion or other liquid substances contained within the dispensing reservoir 50 to the applicator pad 26.

The applicator pad 26 is formed of a sponge-like material having a generally porous quality so as to allow it to be soaked with a sun screen lotion, tanning lotion, tanning oil or the like. Once soaked, the applicator pad 26 can be used to apply a lotion or oil to one's person in a smooth and even layer. In order to enhance its lotion or oil spreading characteristics, the applicator pad 26 may include nubs 27 protruding from and spaced about the surface thereof. Stored within the applicator head 22, the lotion or oil is dispensed through the applicator pad 26 by actuating a pneumatic squeeze pump 30 located below the upper handle length 23.

The flow rate of the lotion or oil dispensed by the lotion applicator 20 can be controlled by adjusting an air valve 31. The air valve 31 defines an adjustable reed valve 32 or other suitable adjustable valve mechanism perpendicularly connected to and in fluid communication with a lower end of an intake tube 33 (to be described in greater), wherein adjustable reed valve 32 extends through aperture 34 of pump housing 70 and rests just outside an outer surface thereof (to be described in greater). In doing so, the amount of air that is used to dispense the lotion or oil is also adjusted, thereby allowing the user to control the flow rate.

A pump housing 70 is mounted near a lower end of the rigid head housing 25 at rotation joint 40. Head securing probes 42 are pivotally attached to the rotation joint 40 and biased by springs 44 so as to apply a clamping force upon the joint 40, thus securing the rigid head housing 25 to the pump housing 70.

The pump housing 70 includes a removable cap 54 that allows for filling/emptying a lotion container 51 with the desired lotion, oil or other substance. The cap 54 includes a male connector 55 that mates with a female connector 37 which serves to provide an air-tight connection between the cap 54 and pump housing 70, thus allowing air to be delivered to the dispensing reservoir 50 from the squeeze pump 30 via an air tube 35. The pneumatic squeeze pump 30 further includes an intake tube 33 which extends perpendicularly therefrom and in fluid communication therewith, which serves as a conduit for directing lotion from the lotion container 51 to the dispensing reservoir 50 via the air tube 35.

A variety of features that would serve to enhance the user's grip are envisioned. A handle strap 66 located on the lower handle length 24 on the side opposite the finger grooves 68 allows for enhanced grip of the lotion applicator 20.

Other features not depicted in the figures are also envisioned in alternate embodiments of the present invention. A battery powered version incorporating an electric pump would automate the lotion or oil delivery system presently powered by the squeeze pump 30. A universal type joint rather than a joint between the upper handle length 23 and the lower handle length 24 would provide for enhanced reach features.

2. Operation of the Preferred Embodiment

In accordance with the preferred embodiment of the present invention the lotion applicator 20 is used in the following manner. The user first removes the cap 54 and fills lotion container 51 with the desired lotion or oil. Once 4 the lotion container 51 is filled, the cap 54 is replaced. Removing the applicator pad cover 26*a*, the user then begins to actuate the squeeze pump 30, creating a positive pressure within the lotion reservoir 50 and forcing the contents thereof through the dispensing apertures 53 and onto the applicator pad 26. The user can adjust the air valve 31 in order to create the desired volumetric flow of lotion or oil through the applicator pad 26.

Once the applicator pad 26 is saturated to the desired degree, the user then uses the lotion applicator 20 to apply lotion to hard-to-reach areas such as one's back. The user can twist the handle 21, causing rotation of the handle rotation joint 40, thus altering the shape of the handle 21 and facilitating an enhanced reach. As the user uses the lotion applicator 20 to apply the lotion or oil, the applicator head 22 pivots on the joint 40, maintaining flush contact between the applicator pad 26 and the user's skin surface. As the lotion or oil is applied, the nubs 27 spread the lotion/oil smoothly and evenly over the skin. As the lotion or oil in the applicator pad 26 is used, it can be replenished using the squeeze pump 30. Once finished with the lotion applicator 20, the applicator pad cover 26a is replaced, leaving the applicator pad 26 in a ready-to-use state.

What is claimed is:

1. A lotion application device comprising:

a handle that supports an applicator head having a generally rigid head housing, said handle having an upper handle length rotatable connected to a lower handle length at a connection located near a midpoint of the handle length and having a handle rotation joint that allows for the rotation of the upper handle length with respect to the lower handle length, said lower handle length defining finger grooves, wherein said handle rotation joint has head securing probes pivotally attached thereto and biased by springs so as to apply a clamping force upon said rotation handle joint, thus securing said pump housing to said rigid head housing an applicator pad cover for covering said applicator head;

a pump housing; and a pneumatic squeeze pump;

wherein lotion stored within said applicator head is dispensed through said applicator pad by actuating said pneumatic squeeze pump located at an end of said lower handle length.

2. The lotion application device of claim 1, wherein said dispensing reservoir includes a lotion container having a dispensing surface that engages with said applicator head.

3. The lotion application device of claim 2, wherein said dispensing surface has a plurality of dispensing apertures spaced thereabout that allow for dispensing of lotion or other liquid substances contained within said dispensing reservoir to said applicator pad.

4. A lotion application device comprising:

a handle that supports an applicator head having a generally rigid head housing, said handle having an upper handle length rotatably connected to a lower handle length at a connection located near a midpoint of the handle length and having a handle rotation joint that allows for the rotation of the upper handle length with respect to the lower handle length, said lower handle length defining finger grooves;

an applicator pad cover for covering said applicator head;

pump housing, wherein said pump housing further comprises a removable cap that allows for filling and emptying said pump housing; and a pneumatic squeeze pump;

wherein lotion stored within said applicator head is dispensed through said applicator pad by actuating said pneumatic squeeze pump located at an end of said lower handle length.

5. The lotion application device of claim 4, wherein said removable cap further comprises a male connector that mates with a female connector which serves to provide an air-tight connection between said removable cap and said pump housing, thus allowing air to be delivered to said dispensing reservoir from said pneumatic squeeze pump via an air tube.

6. The lotion application device of claim 4, wherein said pneumatic squeeze pump includes an intake tube extending perpendicularly therefrom and in fluid communication therewith, which serves as a conduit for directing lotion from said lotion container to said dispensing reservoir via said air tube.

7. The lotion application device of claim 6, wherein said pneumatic squeeze pump further comprises an air valve defined as an adjustable reed valve perpendicularly connected to and in fluid communication with a lower end of said intake tube, wherein said adjustable reed valve extends through an aperture of said pump housing so as to rest just outside an outer surface of said pump housing, thereby allowing user to control a flow rate of lotion.

8. The lotion application device of claim 1, wherein said rigid head housing encases a dispensing reservoir, said dispensing reservoir supports said applicator pad, and wherein said rigid head housing is rotatably connected via said handle rotation to said pump housing.

9. The lotion application device of claim 1, wherein said applicator pad is formed of a sponge-like material having a generally porous quality so as to allow it to be soaked with a lotion.

* * * * *